US005190201A

United States Patent [19]

Briggs

[11] Patent Number: 5,190,201

[45] Date of Patent: Mar. 2, 1993

[54] METHOD AND APPARATUS FOR DETECTING THE PRESENCE OF A WEB WITHIN A WEB DRYER

[75] Inventor: Gerald D. Briggs, Butler, Wis.

[73] Assignee: Quad/Tech, Inc., Sussex, Wis.

[21] Appl. No.: 837,564

[22] Filed: Feb. 18, 1992

Related U.S. Application Data

[63] Continuation of Ser. No. 642,066, Jan. 16, 1991, abandoned.

[51] Int. Cl.[5] ..... B41F 23/04; F26B 13/20; B65H 26/00

[52] U.S. Cl. ..... 26/1; 226/11; 226/45; 101/424.1; 101/484; 34/49; 34/87; 34/156

[58] Field of Search ..... 101/228, 424.1, 484, 101/487, 488; 34/23, 48, 49, 55, 87, 156; 226/11.1, 45

[56] References Cited

U.S. PATENT DOCUMENTS 3,722,105 3/1973 Martney ..... 34/49
3,739,484 6/1973 Wilkening et al. ..... 34/51
3,823,488 7/1974 Houben et al. ..... 34/23
4,698,914 10/1987 Shu et al. ..... 34/23
4,833,794 5/1989 Stibbe et al. ..... 34/156

*Primary Examiner*—Clifford D. Crowder
*Assistant Examiner*—Stephen R. Funk
*Attorney, Agent, or Firm*—Foley & Lardner

[57] ABSTRACT

A method and apparatus for reliably detecting the occurrence of a web break in a web processing system is disclosed employing a non-contacting, non-optical sensor to detect the presence of the web. Cushion pressure in a cushion pressure zone adjacent the web is sensed to determine a web break condition. A sensor block is mounted within an enclosure through which the web passes. The sensor block is configured to sense the cushion pressure in the region between an air bar and the web. The cushion pressure is communicated outside the enclosure to a transducer which compares the cushion pressure to either the internal ambient pressure of the enclosure or to atmospheric pressure. The resulting differential pressure is compared to a threshold differential; if the measured differential pressure drops below the predetermined threshold pressure, a web break is indicated and web processing is terminated.

9 Claims, 5 Drawing Sheets

AIR BAR
END VIEW

METHOD AND APPARATUS FOR DETECTING THE PRESENCE OF A WEB WITHIN A WEB DRYER

This is a continuation of application Ser. No. 07/642,066 filed Jan. 16, 1991, abandoned.

TECHNICAL FIELD

The present invention relates, generally, to methods and apparatus for detecting a web break within a dryer in a web offset printing press, and more particularly to an apparatus for shutting down the press if the difference between the cushion pressure and ambient dryer pressure exceeds a threshold differential.

BACKGROUND ART AND TECHNICAL PROBLEMS

In web-fed printing press systems, a web of material (typically paper) is sequentially driven through one or more printing units comprising a plate cylinder and a print cylinder (blanket cylinder). The blanket cylinders sequentially contact &he web and apply ink thereto to form a composite printed image on the web. As the web exits the printing units, the ink is wet and thus subject to smearing. Accordingly, before further processing, e.g., cutting and folding, the web is typically routed through a drying unit to heat the web to evaporate various solvents in the ink and thus dry the image, then to a chill roller unit to cool the web and set the ink.

Typical drying units comprise an enclosed, elongated housing, enclosing a drying chamber including a plurality of upper and lower air nozzle assemblies spaced apart along its length. The traveling web enters the dryer through a narrow entrance slot and is supported by pressurized, heated air from the nozzle assemblies until it exits the dryer through a discharge slot. In this way, the web may travel through the drying unit in a sinusoidal fashion without coming into physical contact with the drying unit; marring of the image before the ink is fully dried is thus avoided.

During steady state operation of a typical high speed press, the web travels at approximately 2,200 feet per minute (approximately 440 inches per second). If the web breaks downstream of the print cylinders, for example in the dryer, the press will continue to operate at normal speed until the break is detected. It is therefore desirable to quickly detect a web break and to immediately stop the press to minimize wasted paper, ink, and production time.

A more compelling reason for rapid shut-down after a web break surrounds the effect of a web break on a blanket cylinder. The circumferential surface of a blanket cylinder comprises a spongy material which transfers ink from its associated plate cylinder to the web. Each blanket cylinder thus imprints that portion of the composite printed image corresponding to a particular plate cylinder. In printing systems which employ a pair of blanket cylinders on the upper and lower surface of a web to simultaneously apply images to both sides of the web, a nip point is established at the contact point between each of the two blanket cylinders and the web. The cushioned circumferential surfaces of the blanket cylinders are configured to compress slightly at the nip point, thereby maintaining a controlled degree of pressure at the nip point. If the web breaks downstream of the blanket cylinder, the web often tends to wrap around the blanket cylinder. With continued operation, the web continues to wrap around the blanket cylinder, causing multiple layers of paper to pass through the nip point, such that the cumulative thickness of paper increases with each successive blanket wrap. This tends to compress the resilient "blanket". As the number of wraps becomes excessive, for example more than three or four wraps, the blanket may become permanently damaged, requiring removal and replacement of the blanket. Accordingly, it is desirable to terminate press operation before irreparable damage is done to the blanket cylinders.

Presently known systems for detecting a web break and terminating press operation in response thereto are unsatisfactory in several regards. For example, presently known web detection systems are disposed either intermediate the printing units and the dryer or after the dryer, and thus typically do not detect a web break which occurs in the dryer until the break point either travels through the dryer or is pulled back through to the entrance of the dryer, resulting in a delay of up to one second or more between the occurrence of the web break and the detection of the web break.

Web break detection systems employing an infrared sensor in conjunction with fiber optic cables to sense the presence of the web within the dryer are known. One example of such a system is the Dryer Web Break Detector, Model 1126 manufactured by the Baldwin Technology Corporation of Stamford, Conn. However, the sensing mechanism tends to become obscured by the various chemicals, solvents, and smoke produced within a dryer environment, resulting in a relatively low degree of reliability of such "in-dryer" web detection systems.

Another known web detection system directs a sonic wave of known frequency at the web surface, and compares the frequency of the reflected wave to the incident wave. If the frequency of the reflected wave is greater or less than the incident wave, or if no reflected wave is sensed, the system indicates a web break.

Another known device comprises a feeler gauge; a spring biased feeler is placed in contact with the web surface. If the web breaks, the feeler pivots toward the plane of the web, triggering generation of a web break signal.

It is also known to dispose a spring loaded switch directly below the web surface and to direct an air stream at the upper surface of the web opposite the switch. As long as the web is intact, the air stream impinges on the web and does not actuate the switch. When the web is broken, the air stream is permitted to actuate the switch, signalling a web break.

To the extent the foregoing systems employ electrical components or moving mechanical components, they are unsatisfactory for use within a dryer, where temperatures may approach 500°-600° F.

A web detection system is needed which overcomes the shortcomings of existing sensing apparatus. Specifically, a web detection system is needed which is capable of sensing the presence or absence of a web within a dryer environment, and which is capable of reliably sensing a web break at high temperatures and in the presence of solvents and dense smoke.

SUMMARY OF THE INVENTION

The present invention provides methods and apparatus for reliably detecting the occurrence of a web break within a web drying unit. This is accomplished by employing a noncontact, non-optical sensor to detect the presence of the web in the dryer. In one aspect of the present invention, the dryer cushion pressure is sensed to determine a web break condition. In a preferred embodiment, a sensor block is mounted within the dryer and configured to sense the cushion pressure in the region between an air bar and the web supported thereby. This cushion pressure is fed outside the dryer to a transducer which compares the cushion pressure to either the internal ambient pressure of the dryer or to atmospheric pressure. The resulting differential pressure is compared to a threshold differential; if the measured differential pressure drops below the predetermined threshold pressure, a web break is indicated and press operation is terminated.

Such an embodiment is particularly advantageous; all electrical and mechanical sensing elements are located outside the dryer environment and are thus not subject to corrosion, extreme heat, or smoke. A high degree of reliability is obtained, thereby reducing unnecessary press stops ("ghost stops") due to the spurious generation of a web break signal.

BRIEF DESCRIPTION OF THE DRAWING

Various embodiments of the subject invention will hereinafter be described in conjunction with the appended drawing, wherein like numerals denote like elements, and.

DETAILED DESCRIPTION OF PREFERRED EXEMPLARY EMBODIMENTS

Figure 1:
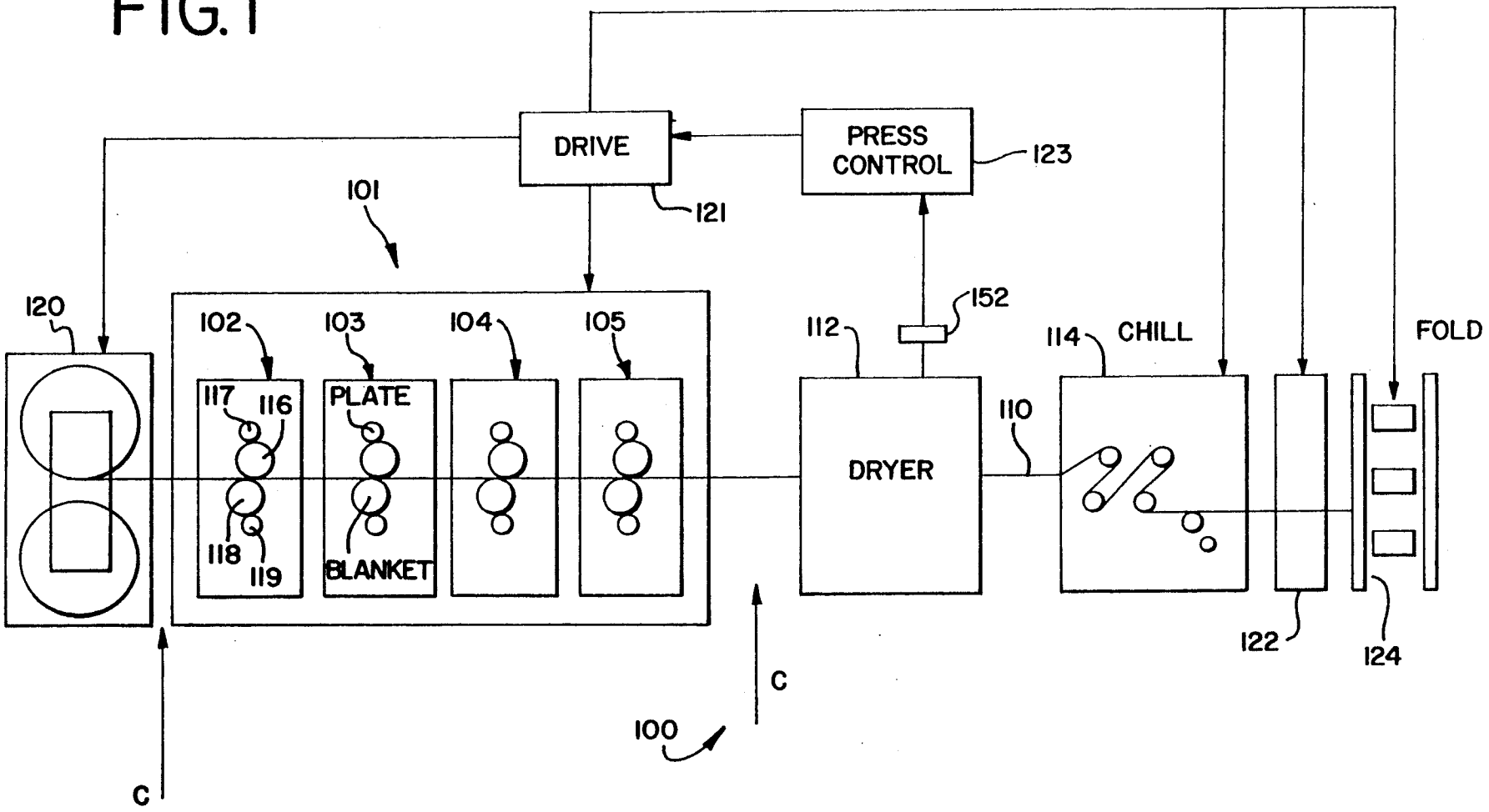
FIG. 1 is a schematic view of a printing press system including a plurality of print cylinders, a dryer unit, and a web passing therethrough.

Referring now to FIG. 1, a web-fed printing system 100 preferably includes a printing press 101 having a plurality of serially disposed conventional printing units 102, 103, 104, and 105, and operates upon a driven web 110. In a web offset printing press, each of printing units 102–105 advantageously includes an upper blanket cylinder 116, an upper plate cylinder 117, a lower blanket cylinder 118, and a lower plate cylinder 119. Web 110, typically paper, is fed from a reel stand 120 through each of printing units 102–105 in sequence and thereafter through a conventional dryer unit 112 (e.g., a TEC "Phasor" model dryer) and conventional chill unit 114. Web 110 is then suitably guided through a coating unit 122 to a folding station 124 which folds and separates the web into individual signatures. Reel stand 120, printing press 101, printing units 102–105, chill roll 114, coating unit 122 and folder 124 are typically driven by a common drive 121. Drive 121, in turn, is controlled by a press control 123, for example a conventional stand alone microcomputer.

Printing units 102–105 cooperate to imprint multicolor images on the upper and lower surfaces of web 110. Each printing unit 102–105 prints an associated color of ink; typically the first sequential print unit 102 prints the color black, and subsequent units 103–105 print other colors such as cyan, magenta, and yellow. Print unit 105 is referred to herein as the terminal print unit. Each of the lateral and rotational positions of upper and lower plate cylinders 117, 119 is separately controlled by electric motors (not shown) to precisely register the respective images generated by the individual printing units.

When a web break is detected during the printing process, it is desirable to terminate press operation as quickly as possible to minimize wasted paper, ink, personnel and machine time, and to reduce the risk of equipment damage, as will be hereinafter explained in greater detail.

In the event web 110 breaks downstream of terminal print cylinder 105 and before dryer 112, double wrapping tends to occur; the upstream portion of the web being fed to the blanket cylinder wraps around the blanket cylinder, while the downstream portion of the web is pulled back through the dryer and also wraps around the blanket cylinder at the same time. Thus, for each revolution of the blanket cylinder, the web may wrap around the blanket cylinder twice.

System response to a web break generally involves: 1) generating an "E-stop" (emergency stop) signal by press control unit 123 and applying the signal to press drive unit 121 to effect a rapid deceleration of drive mechanism 121, thus effecting rapid deceleration of web reel stand 120, print units 102–105, chill roll 114, coating unit 122, and folding unit 124; and 2) severing the web, at various predetermined points along the length thereof (for example at points C in FIG. 1), into discrete segments to thereby limit the number of times a web segment may wrap around a blanket cylinder.

In a preferred exemplary embodiment, dryer 112 is suitably approximately 349 inches long. Thus, a given point moving at 2,200 feet per minute (440 inches per second) proceeds through the dryer in approximately 0.8 seconds. For an exemplary blanket cylinder 116, 118 having a circumference of approximately 45.75 inches, the web wraps around the blanket cylinder in approximately 100 milliseconds. A web break which occurs near the exit of dryer 112 but which is not detected until after the broken web is drawn back through dryer 112 may thus result in a delay of approximately 800 milliseconds (0.8 seconds), or up to 16 total blanket wraps before the broken web is detected. This is more than sufficient blanket wrap to permanently damage a "blanket," i.e., the spongy circumferential surface of a blanket cylinder which applies the ink to the web.

The web detection system in accordance with one aspect of the present invention is configured to detect a web break within the dryer and terminate press operation immediately upon the detection of a web break.

Referring now to FIGS. 2–5, web 110 (FIG. 2) travels through dryer 112 in an essentially serpentine manner. More specifically, dryer 112 comprises upper and lower surfaces 136 and 138 upon which a plurality of equally spaced, laterally extending air bars 130, 132 are mounted. Each air bar 132 mounted on lower surface 138 is interposed midway between each air bar 130 mounted on upper surface 136, as is known in the art. In this configuration, web 110 approximates a sinusoidal path as it travels through the dryer.

An internal region 140 is defined by upper and lower surfaces 136 and 138. As will be explained in greater detail, the internal pressure within the dryer, generally comprising region 140, is maintained at a predetermined "ambient" dryer pressure, except for a plurality of discrete regions 142, defined between web 110 and the distal end of each air bar 130, in which a higher pressure, referred to herein as the "cushion" pressure, is maintained. Web 110 essentially floats through the dryer supported by cushions of air discharged from respective air bars 130 to form high pressure regions 142.

One or both surfaces of web 110 are partially coated with ink and various solvents upon entering dryer 112. Dryer 112 suitably maintains a steady state operating temperature in the range of 300°-350° F., which temperature may approach 500° or more in some circumstances. The high temperature dryer environment evaporates the solvents from the surface of web 110, resulting in smoke, fumes, particulate debris, and precipitates being liberated from the surface of web 110 during drying. The internal environment of dryer 112 is thus ill-suited for sensing apparatus employing electrical components or moving mechanical parts.

Figure 2:
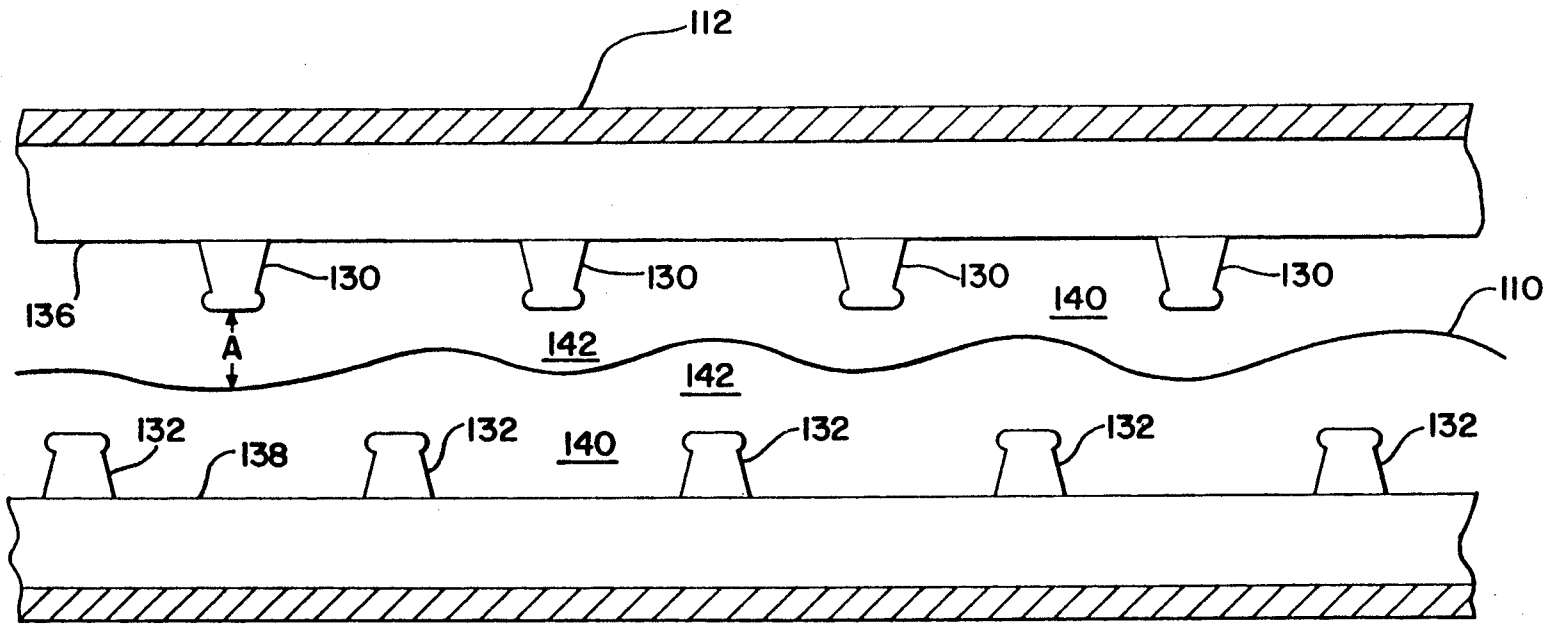
FIG. 2 is a cut-away schematic view of a portion of the internal region of a dryer unit showing the web travelling therethrough.

The fumes generated during the drying process are also often corrosive, caustic, noxious and even toxic to personnel working in the vicinity of the printing press. Accordingly, the ambient pressure, i.e., the internal dryer pressure in region 140, is advantageously maintained below atmospheric pressure, for example 1.5 to 2 psi below atmospheric. Large suction conduits (not shown) are positioned along the length of dryer 112 to exhaust the fumes from the dryer and maintain a substantially constant static ambient pressure. At the same time, high pressure air is discharged from each of respective air bars 130, thus creating the cushion pressure at each of high pressure zones 142. The magnitude of the cushion pressure is maintained at a level sufficient to substantially stabilize web 110 along the entire length of dryer 112. As a result, the distance between web 110 and the free end of each air bar 130, generally indicated as dimension A in FIG. 2, is advantageously maintained within the range of approximately ¼ to ½ inch.

Maintenance of the cushion pressure is predicated upon maintenance of web tension which, in turn, depends on the presence of an intact web 110; thus, if web 110 breaks, cushion pressure 142 quickly drops. By monitoring the magnitude of the cushion pressure, and more particularly by monitoring the difference between the cushion pressure and the ambient pressure, a web break may be quickly detected and press operation quickly terminated. This is true regardless of whether the web break occurs within or outside of dryer 112; web tension is quickly reduced in either event, thereby substantially instantaneously reducing the magnitude of the cushion pressure.

Figure 4:
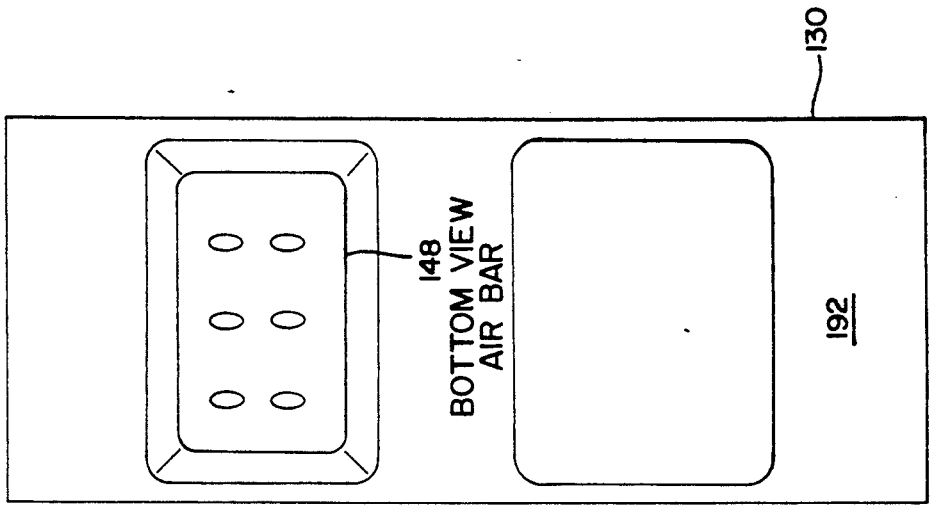
FIG. 4 is a bottom view of the air bar shown in FIG. 3.
Figure 3:
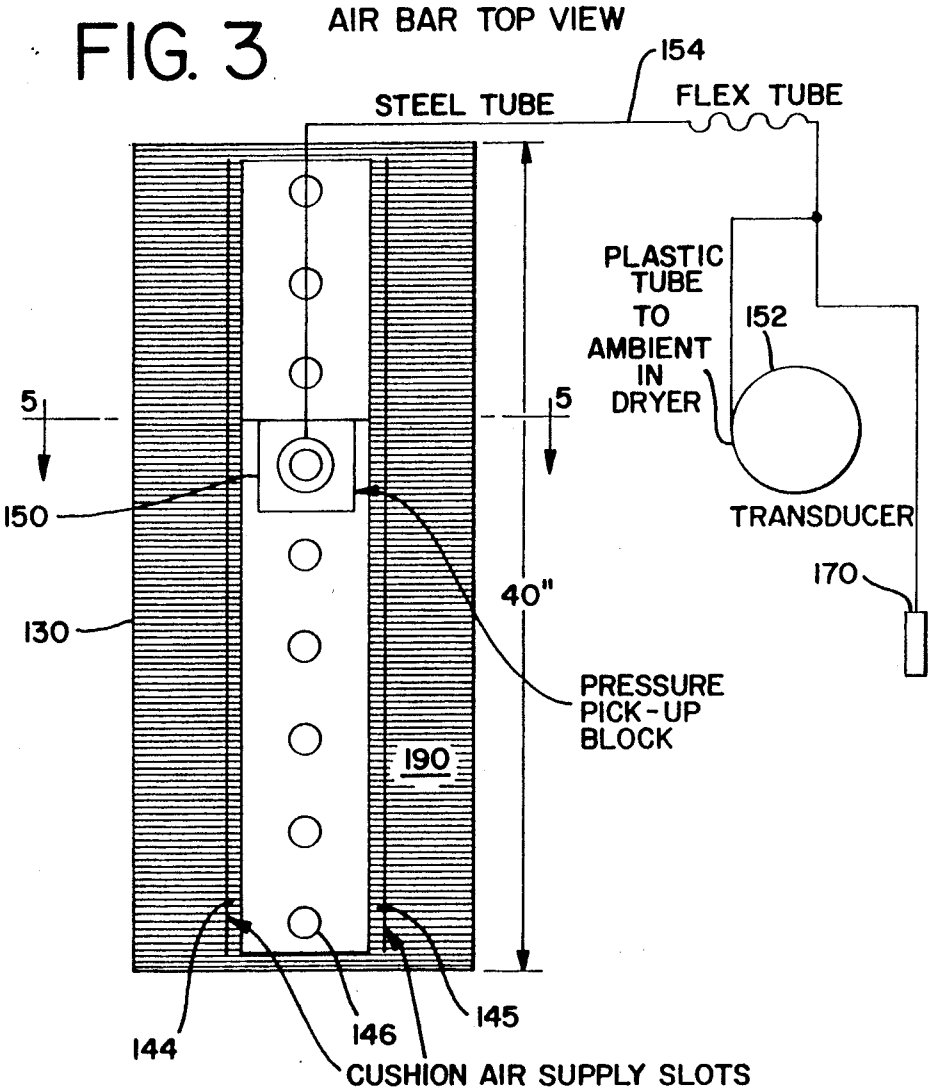
FIG. 3 is a top view of an exemplary air bar and a schematic view of a pressure sensor.
Figure 5:
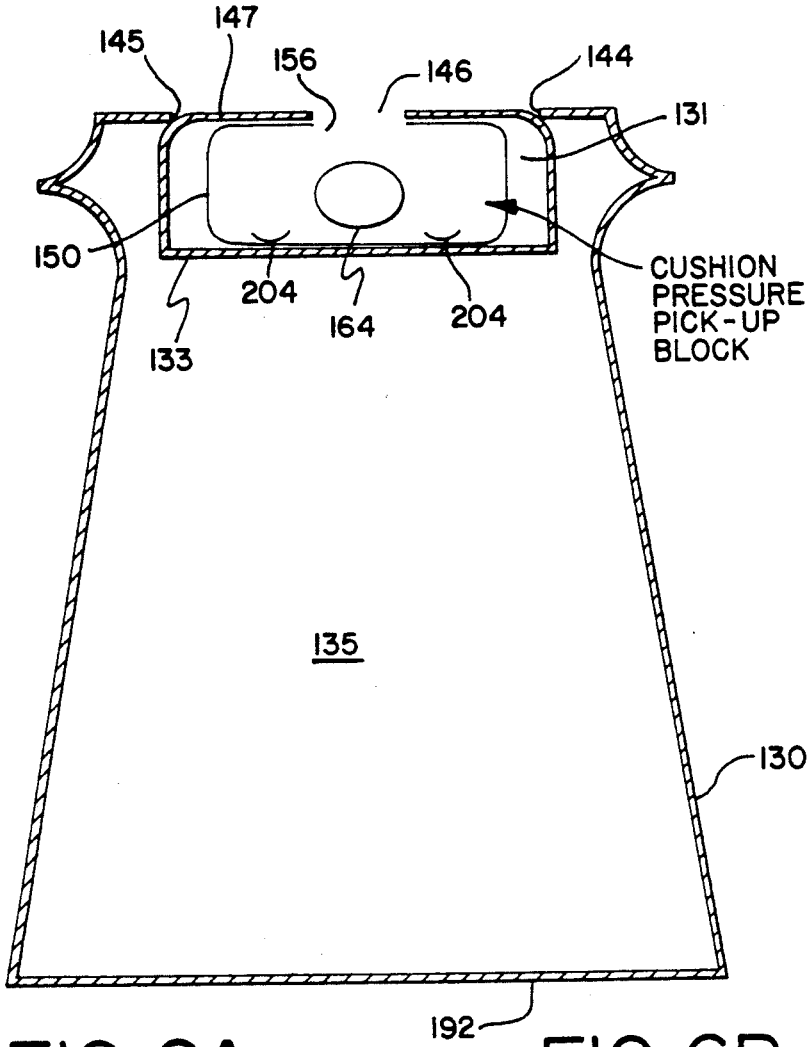
FIG. 5 is an end view of the air bar shown in FIGS. 3 and 4.

As best seen in FIGS. 3-5, an exemplary air bar 130 suitably comprises a plurality of spaced-apart cushion air return holes 146 flanked by respective cushion air supply slots 144 and 145 disposed along an upper surface 190 of air bar 130 (FIG. 3). Return holes 146 penetrate an outlet barrier 147 and communicate with an elongated channel 131 (FIG. 5) extending along the length of air bar 130. During steady state operation of dryer 112, air is supplied from an air inlet manifold (not shown) into a plenum 148 (FIG. 4) located on a bottom surface 192 of air bar 130 opposite cushion air return holes 146. The air enters interior region 135 and passes out supply slots 144, 145. A swirling effect is created as high pressure cushion air enters high pressure region 142 through cushion air supply holes 144, 145, impinges upon web 110, and returns through cushion air return holes 146, passing outlet barrier 147. The flow then carries exhaust air through channel 131 and exits air bar 130 at the ends of air bar 130. High pressure cushion air zones 142 support and stabilize web 110 as it travels through the dryer.

With reference now to FIGS. 3 and 5-6, a pressure pickup block 150, secured within channel 131 of air bar 130, provides direct communication between high pressure zone 142 and a transducer 152, located outside dryer 112, through a pressure transmission conduit 154. Back pressure adjacent cushion air return holes 146 which is established by cushion pressure within dryer 112 is monitored, and in this way, the actual cushion pressure is maintained and monitored outside of the hostile dryer environment. Transducer 152 suitably comprises a differential transducer made by Cavlico Company of California, for example Part No. P582DA1A.

Figure 6A:
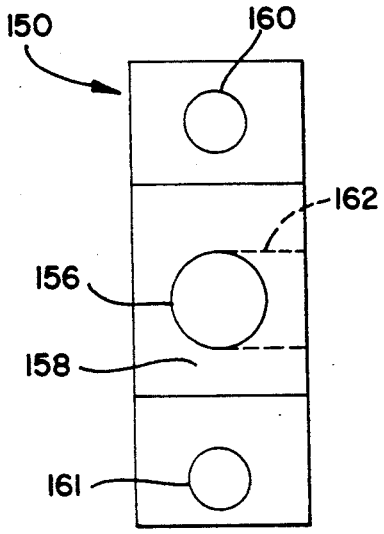
FIGS. 6 (A) and (B) represent top and side views, respectively, of an exemplary embodiment of a sensor block.
Figure 6B:
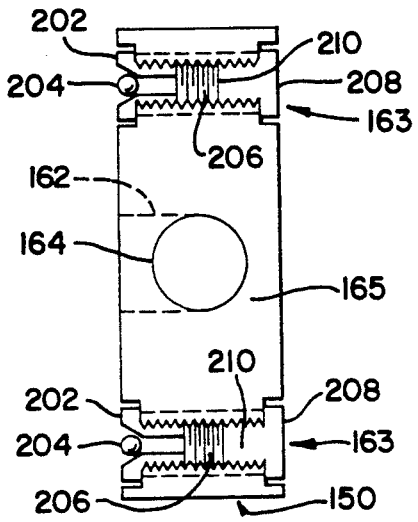

Referring now to FIGS. 6A and 6B, pressure block 150 suitably comprises an aperture 156 disposed on a top surface 158, a discharge port 164 disposed on a side surface 165, and an internal transmission path 162 communicating therebetween. In addition, respective threaded cylindrical bores 160, 161 each house a ball assembly 163 comprising a hollow, threaded screw 202, a ball 204 received therein, a compression spring 206, and a seat screw 208 having spring seat 210 disposed at one end thereof.

Ball assembly 163 is configured such that one end of spring 206 rests on seat 210 and the other end biases ball 204 in the opposite direction. The extent to which screw 208 is turned into bore 160 determines the biasing force of spring 206 on ball 204. A separate ball assembly 163 is received within bore 161 in a similar manner.

During installation of pressure block 150 within air bar 130, balls 204 are biased against barrier 133 to maintain block 150 snugly Within channel 131. Block 150 may thus be slidingly urged along channel 131 until aperture 156 is aligned with one of cushion pressure return holes 146, for example approximately midway along the length of air bar 130. Upon aligning aperture 156 with an air return hole, pressure transmission conduit 154 is secured to aperture 156 of pickup block 150 in any convenient manner, such that an unobstructed path is maintained between cushion pressure zone 142, through aperture 156, transmission path 162, discharge port 164, and pressure conduit 154, terminating at transducer 152.

If desired, a drip tube 170 may be interposed along pressure conduit 154 proximate transducer 152 in the event it is necessary to discharge any fluid which may accumulate in pressure conduit 154. Drip tube 170, pressure transmission conduit 154, and transducer 152 may be configured such that any precipitation which may accumulate in pressure transmission conduit 154 is drawn by gravity to a position below transducer 152, thereby preventing fluid from entering transducer 152.

In the preferred exemplary embodiment, transducer 152 and drip tube 170 are disposed outside of dryer 112. Thus, there are no electrical components or moving parts disposed within the caustic, high temperature dryer environment. By providing a substantially unobstructed path between a cushion air return hole 146 and transducer 152, a dependable analog cushion pressure signal may be maintained outside of dryer 112, i.e., cushion pressure may be measured from the exterior of dryer 112.

Cushion pressure from pressure transmission conduit 154 is applied to the high side of differential transducer 152. A similar static conduit system (not shown) may be used to port ambient dryer pressure to the low side of transducer 152. In response, transducer 152 generates an electrical signal DP (FIG. 7) indicative of the differential pressure between the cushion pressure and the ambient pressure. As explained below, software resident in press control unit 123 compares the magnitude of the differential signal DP with a predetermined threshold value; if the differential pressure dips below the threshold, a web break is signalled, and press operation is terminated.

The present inventor has achieved satisfactory results by independently employing one sensor block 150 in each of two air bars, for example at approximately one-third and two-thirds of the length of the dryer. Of course, more or less sensors may be employed depending on such factors as dryer length, press speed, sensor cast, and desired response time.

Figure 7:
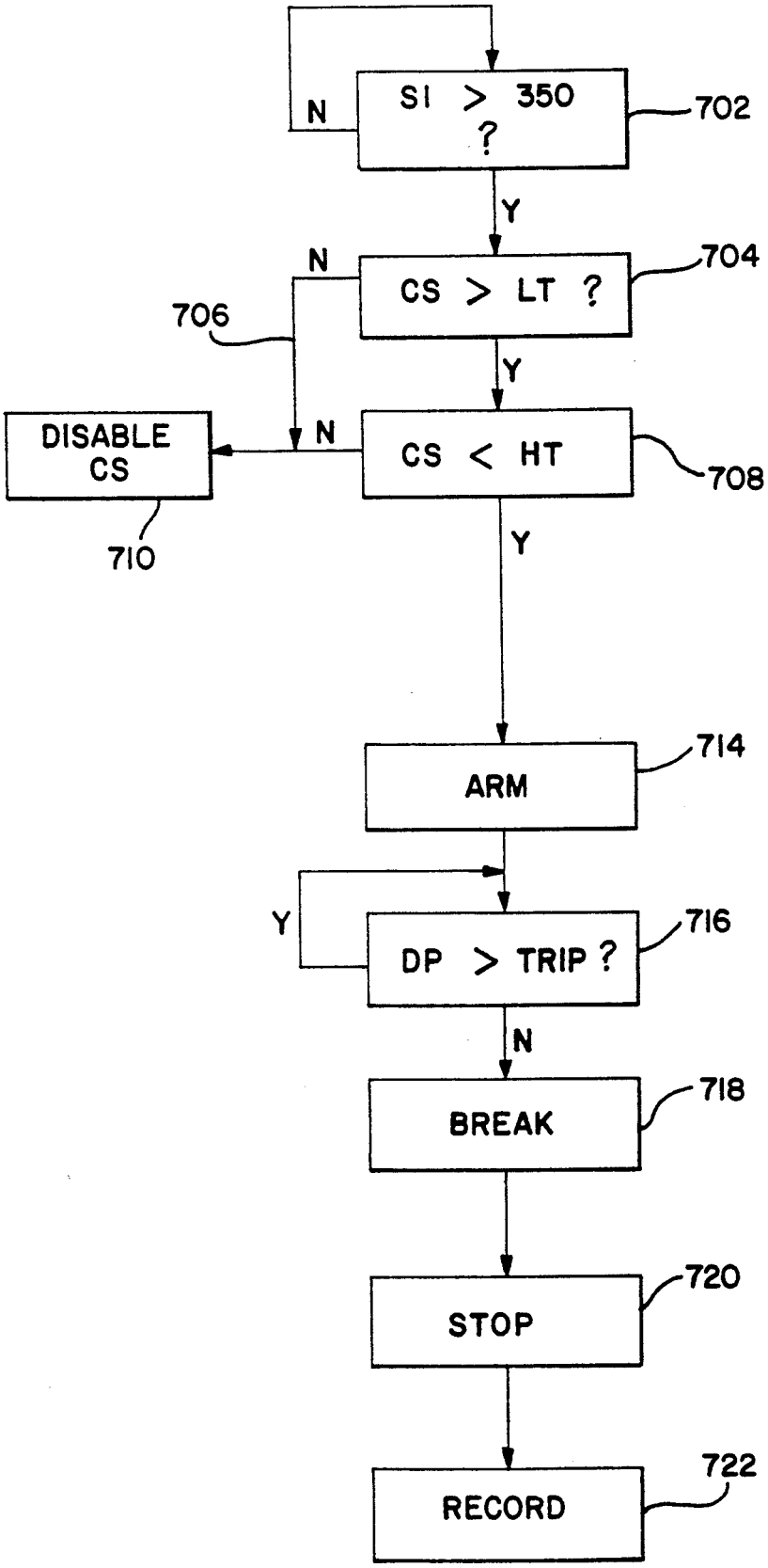
FIG. 7 is a block diagram flow chart illustrating the operation of the web break detection system.

Referring now to FIG. 7, a series of initialization tasks are performed by software resident in control unit 123 prior to "arming" the system, i.e., bringing the web detection system into an operational state. Alternatively, the software can be implemented outside of the press controller in ladder logic utilizing, for example, a T1 530 T computer employing a PLC platform.

Processing begins when a signal S1 from the press indicates that the press is powered up and that the web is travelling above a predetermined threshold speed, for example 450 feet per minute (STEP 702). At that point, each individual cushion sensor (CS) is checked (STEP 704) to ensure that the pressure level at that sensor exceeds a predetermined low out-of-tolerance value (LT) established by the operator, which value is preferably near or slightly above atmospheric pressure. If the output of any particular sensor (CS) is below the low out-of-tolerance threshold (LT), that sensor is disabled (STEP 706) and a LED on control unit 123 is lit indicating that either: (1) the sensor is malfunctioning or (2) the air bar is not supplying sufficient pressure to the cushion pressure region in which the sensor is located. An additional advantage of the foregoing configuration surrounds the provision of indicia of an "ON" condition of the air bar, thus providing the operator with information pertaining to dryer operation without regard to the presence of a web break.

The system then checks to ensure that the pressure level at each sensor is below a predetermined high threshold value (HT) (STEP 708). If a particular sensor indicates a cushion pressure greater than a predetermined upper limit, that sensor is disabled (STEP 710) indicating that either the air bar or the sensor is not functioning properly. An appropriate LED may be activated on a control board to alert the operator of the malfunction.

In an alternate preferred embodiment, a timer may be set when the press reaches a predetermined threshold startup speed, for example 450 feet per minute, to allow each sensor and each air bar to stabilize for a predetermined duration, for example 60 seconds. If a particular sensor measures a pressure less than the low threshold value (LT) or greater than the high threshold value (HT) during the 60 second period, that sensor is disabled; if after the 60 seconds has timed out a particular sensor has not dipped below the low threshold value (LT) or exceeded the high threshold value (HT), that sensor will not be disabled.

When the press has reached the threshold start-up speed and only the properly functioning sensors remain enabled, the press is considered operational and the web detection system becomes armed (STEP 714). The system is now ready to begin detecting web breaks.

A differential pressure signal DP, generated by transducer 152, is compared to a trip value (TRIP) set point (STEP 716) indicative of a predetermined desired difference between the cushion pressure and the ambient pressure within the dryer. In many high-speed offset printing applications, it is desirable to maintain the cushion pressure above ambient dryer pressure by an amount in the range of about 1 to 3 psi, and most preferably about 2 psi. Those skilled in the art will appreciate that conventional dryer systems are configured to maintain the cushion pressure at a predetermined amount above the ambient pressure, notwithstanding transient variations in the ambient pressure. As long as differential pressure signal DP remains above trip point value TRIP, the press is permitted to run normally. If the differential pressure drops below the trip point, the system determines that a web break has occurred (STEP 718) and immediately performs two functions: 1) an E-stop signal (STOP) is generated by control unit 123 (STEP 720) and applied to the press drive unit 121 to immediately terminate press operation; and 2) the precise time the web break was detected is recorded in memory for future reference (STEP 722).

The foregoing method has performed satisfactorily in situations where the dryer doors remain closed, i.e., in situations where ambient pressure remains essentially constant. However, from time to time it may be necessary to open the dryer doors and access the interior of the dryer. Opening the dryer doors allows atmospheric pressure to permeate the interior of the dryer, causing the ambient dryer pressure to quickly rise to approximately the level of atmospheric pressure. Although presently known dryer systems are configured such that the cushion pressure responds to changes in ambient pressure and thereby maintains an essentially constant pressure differential therebetween, there is often a brief lag between a sudden increase in ambient pressure and a corresponding increase in cushion pressure. During this lag, for example immediately after the dryer doors are opened, it is possible that ambient pressure may increase sharply before the air bar blower motors can react quickly enough to maintain the desired differential between cushion pressure and ambient pressure. Consequently, the pressure differential may dip below the TRIP level, resulting in a ghost-stop, i.e., an erroneous indication of a web break due to spurious changes in cushion and/or ambient pressure.

The present inventor has determined that a significant number of ghost-stops may be avoided by disabling the system while the dryer doors are opened. More particularly, an auxiliary differential pressure transducer (not shown), substantially identical to transducer 152, may be employed to monitor the ambient pressure by applying atmospheric pressure to the high side of the auxiliary transducer and applying ambient dryer pressure to the low side in much the same way as discussed above in connection with transducer 152. By monitoring the differential between ambient and atmospheric pressure, and comparing the differential to a predetermined threshold level, the web detection system may be advantageously disabled while the dryer doors are opened, thereby greatly reducing the incidence of ghost-stops attributable to the opening of the dryer doors.

Those skilled in the art will appreciate that the present invention has been described in connection with preferred exemplary embodiments only. Various changes and modifications in the design and implementation of the methods and apparatus discussed herein may be made without departing from the spirit of the invention as expressed in the appended claims.

I claim:

1. An apparatus for detecting a break in a web in a web offset printing system, the apparatus comprising:

an enclosure, said enclosure having an interior, an entrance aperture and an exit aperture, said interior being intermediate said entrance aperture and said exit aperture, said web traversing said interior from said entrance aperture to said exit aperture;

a fluid pressure means within said interior for providing a fluid flow within said interior, said fluid pressure means providing at least one inlet to said interior and providing at least one outlet from said interior for establishing said fluid flow, said at least one outlet meeting said interior at an outlet boundary, said fluid flow generally flowing from said at least one inlet, through a cushion pressure zone at a surface of said web within said interior, and through said at least one outlet past said outlet boundary and creating a cushion pressure in said cushion pressure zone; and a sensing means for sensing pressure, said sensing means being disposed to sense said cushion pressure substantially at said outlet boundary.

2. An apparatus for detecting a break in a web as recited in claim 1 wherein said sensing means comprises a sensor and a communication means for communicating pressure, said sensor being situated outside said enclosure, said communication means communicating said cushion pressure from within said interior substantially at said outlet boundary to said sensor.

3. An apparatus for detecting a break in a web as recited in claim 2 wherein said communication means comprises a conduit.

4. An apparatus for detecting a break in a web as recited in claim 3 wherein said communication means further comprises a block means for locating said conduit substantially adjacent said outlet boundary; said block means including fixing means for fixing said block means with respect to said fluid pressure means, said block means being adjustably fixable by said fixing means with respect to at least one selected outlet of said at least one outlet.

5. A method for detecting a web break in a web fed printing press, the method comprising the steps of:

guiding said web through an enclosure, said enclosure defining an interior intermediate an entrance aperture and an exit aperture, said web traversing said interior from said entrance aperture to said exit aperture;

providing a fluid pressure means within said interior for generating a fluid flow within said interior, said fluid pressure means having at least one inlet to said interior and at least one outlet from said interior for establishing said fluid flow, said at least one outlet meeting said interior at an outlet boundary, said fluid flow generally flowing from said at least one inlet through a cushion pressure zone at a surface of said web within said interior, and through said at least one outlet past said outlet boundary and creating a cushion pressure in said cushion pressure zone; and sensing said cushion pressure substantially adjacent said outlet boundary.

6. A method for detecting a web break in a web fed printing press as recited in claim 5 wherein said sensing is effected by a sensing means, said sensing means comprising a sensor and a communication means for communicating pressure, said sensor being situated outside said enclosure, said communication means communicating said cushion pressure from within said interior substantially adjacent said outlet boundary to said sensor.

7. A method for detecting a web break in a web fed printing press as recited in claim 6 wherein said communications means comprises a tube.

8. A method for detecting a web break in a web processing system, the method comprising the steps of:

(1) guiding said web through an enclosure, said enclosure defining an interior intermediate an entrance aperture and an exit aperture, said web traversing said interior from said entrance aperture to said exit aperture;

(2) providing a fluid flow means within said interior for establishing a fluid flow within said interior, said fluid flow means including at least one inlet to said interior and at least one outlet from said interior, said at least one outlet meeting said interior at an outlet boundary, said fluid flow generally flowing from said at least one inlet through a cushion pressure zone at a surface of said web within said interior, and through said at least one outlet past said outlet boundary, creating a cushion pressure in said cushion pressure zone; and (3) sensing said cushion pressure substantially at said outlet boundary to detect said break.

9. An apparatus for detecting a break in a web in a web offset printing system, the apparatus comprising:

an enclosure, said enclosure having an interior, an entrance aperture and an exit aperture, said interior being intermediate said entrance aperture and said exit aperture, said web traversing said interior from said entrance aperture to said exit aperture;

a fluid means within said interior for providing a fluid flow within said interior, said fluid pressure means providing at least one inlet to said interior and providing at least one outlet from said interior for establishing said fluid flow, said at least one outlet meeting said interior at an outlet boundary, said fluid flow generally flowing from said at least one inlet, through a cushion pressure zone at a surface of said web within said interior, and through said at least one outlet past said outlet boundary and creating a cushion pressure in said cushion pressure zone; and a sensing means for sensing pressure, said sensing means being disposed to sense said cushion pressure substantially at said outlet boundary;

said sensing means comprising a sensor and a communication means for communicating pressure, said sensor being situated outside said enclosure, said communication means communicating said cushion pressure from within said interior substantially at said outlet boundary to said sensor;

said communication means comprising a conduit and a block means for locating said conduit substantially adjacent said outlet boundary; said block means including fixing means for fixing said block means with respect to said fluid pressure means, said block means being adjustably fixable by said fixing means with respect to at least one selected outlet of said at least one outlet.

* * * * *